US005241916A

United States Patent [19]

Martin

[11] Patent Number: 5,241,916

[45] Date of Patent: Sep. 7, 1993

[54] PROCEDURE FOR SUPPLYING COMBUSTION AIR AND A FURNACE THEREFOR

[75] Inventor: Johannes J. E. Martin, Seeshaupt, Fed. Rep. of Germany

[73] Assignee: Martin GmbH für Umwelt- und Energietechnik, Munich, Fed. Rep. of Germany

[21] Appl. No.: 829,963

[22] Filed: Feb. 3, 1992

[30] Foreign Application Priority Data

Feb. 7, 1991 [EP] European Pat. Off. ..... 91101711.9

[51] Int. Cl.[5] ..... F23L 1/00; F23L 9/00

[52] U.S. Cl. ..... 110/348; 110/204; 110/205; 110/206; 110/298; 110/300; 110/303

[58] Field of Search ..... 110/341, 204, 205, 206, 110/300, 299, 348, 303, 297

[56] References Cited

U.S. PATENT DOCUMENTS 3,473,331 10/1969 Fernandes ..... 110/204 X
4,056,068 11/1977 Hafeli ..... 110/348 X

FOREIGN PATENT DOCUMENTS 1019788 11/1957 Fed. Rep. of Germany .
3913886 10/1990 Fed. Rep. of Germany ..... 110/204
352231 7/1931 United Kingdom ..... 110/204
354872 8/1931 United Kingdom ..... 110/206

*Primary Examiner*—Edward G. Favors
*Attorney, Agent, or Firm*—McAulay Fisher Nissen Goldberg & Kiel

[57] ABSTRACT

The procedure for supplying combustion air during grate firings, in which the primary combustion air is introduced into the fuel, and secondary combustion air is introduced directly into the flow of exhaust gas, and in which, in addition, some of the exhaust gas is tapped off from the flow of exhaust gas and returned to the combustion process, includes the withdrawal of exhaust gas directly above the fuel in the area where there is a large quantity of unused primary air, and the delivery of this exhaust gas that has been tapped off to the combustion air, the quantity of which is reduced according to the quantity of exhaust gas that is mixed with it.

13 Claims, 3 Drawing Sheets

PROCEDURE FOR SUPPLYING COMBUSTION AIR AND A FURNACE THEREFOR

BACKGROUND OF THE INVENTION a) Field of the Invention

The present invention relates to a procedure for supplying combustion air during grate firings, in which primary combustion air is introduced through the fuel and secondary combustion air is introduced directly into the flow of exhaust gas and in which, in addition, some of the exhaust gas is tapped from the flow of exhaust gas and returned to the combustion process. The present invention also relates to a furnace for carrying out this procedure.

b) Background Art

In a mechanical furnace grate system, as a rule, the necessary combustion air that is added is divided into one part of primary combustion air, which is introduced into the fuel on the grate through the construction of the grate itself or through the rods that make up the grate, and secondary combustion air, which is introduced into the secondary combustion zone of the fire box above the furnace grate. In order to achieve complete combustion of both the solid and gaseous combustion residues, in all furnace grate systems, the combustion air is added in quantities that are above the stoicheomtrical quantity, i.e., more combustion air is added than would be required, in the ideal case, for the complete oxidation of the fuel. Each method of operation that is based on the above-stoicheometric quantities of necessity causes a reduction of the efficiency of a waste-heat boiler that is installed after the fire grate system, for the excess combustion air also has to be heated as ballast. In conventional combustion grate systems, this stoicheometric ratio lies in the range of 1.4 to 2.2.

Many furnace grate systems are divided into plurality of primary air zones in the direction of flow of the fuel. This division into different zones makes it possible to introduce primary combustion air as required, and in accordance with the particular conversion rate of the fuel. However, primary combustion air is frequently introduced into the rear area of the furnace grate, where, as a rule, there is only completely burned fuel, in order to cool the slag or to maintain the mechanical function of the grate surface. Within this area, there is no longer any conversion in the sense of a chemical reaction. Thus, in this area of the combustion chamber above the furnace grate there is a zone in which the gases are present, in slightly heated form, although their composition is very close to the composition of the primary combustion air that is introduced.

This portion of the primary combustion air, which no longer takes part in any chemical reaction, causes a considerable increase in the overall gas volume. A direct and disadvantageous consequence of this is that the apparatuses such as waste heat boilers or apparatuses used to scrub the exhaust gases, and which are incorporated after the combustion chamber have to be made correspondingly big, and are thus more costly. As has already been stated, the efficiency of such a furnace is also reduced by this excessive air ballast. Finally, this excessive proportion of air also results in greater quantities of injurious substances such as carbon monoxide and nitrogen oxides.

OBJECT AND SUMMARY OF THE INVENTION

It is a primary object of the present invention to describe a procedure and an appratus for carrying out the procedure, with the help of which the quantity of the exhaust gas flow and thus the disadvantageous subsequences that result from the aforementioned excess air can be avoided.

It is already known that exhaust gas ca be tapped off from the system and returned once again to the combustion process in order to reduce the oxygen content in the exhaust gases; however, up to now, the exhaust gas is tapped off only after passing through a cooling section, i.e., after passing through the waste-heat boiler or after passing through a gas scrubber. This means however that the gas volume of the exhaust gas is not reduced by these aggregates, so that, as has previously been the case, they must still be laid out such that they can accommodate the throughput of this large volume of exhaust gas.

In contrast to this, according to the present invention, the exhaust gas is tapped off immediately above the fuel in the area where there is a large quantity of unconsumed primary air, and re-added to the combustion air, the quantity of which is reduced in accordance with the quantity of exhaust gas that is to be mixed with it.

Because of this, the overall exhaust gas flow can be reduced by that proportion that is tapped off from the rear combustion chamber and returned to the combustion air. The fresh combustion air can thus be reduced by corresponding amount because, as has been discussed above, the composition of this exhaust gas is close to the composition of fresh combustion air because of the absence of any chemical reaction. In the known processes, it is not possible to effect a correspondingly large reduction of the fresh combustion air because the withdrawal of the exhaust gas takes place at a point where all the exhaust gas fractions that which are generated above the furnace grate are mixed together, so that this exhaust gas no longer possesses the quantity of oxygen that is required for combustion.

Because of the reduction of the total volume of exhaust gas, the assemblies that are incorporated downstream from the combustion chamber can be smaller, which has made it possible to achieve a considerable reduction in plant costs. A further advantage of this method of operation according to the present invention is seen in the reduction of the emissions of injurious substances such as carbon monoxide and nitrogen oxide. These effects are based, on the one hand, in the case of carbon monoxide, on a more intensive secondary combustion of a flow of gas that has a relatively high content of this injurious substance. In the case of nitrogen oxides, the reduction of concentration that has been observed can be explained by the reduction of the oxygen content in the exhaust gas.

If, in an advantageous configuration of the procedure, the quantity of exhaust gas that is tapped off corresponds by volume to the quantity of primary air that is added to the rear primary air zones, then the benefits that can be achieved can be maximized.

However, it can also be advantageous that the quantity of exhaust gas that is tapped off is greater or smaller, by volume, than the quantity of primary air that is introduced into the furnace grate in the rear primary air zones.

The quantity of exhaust gas that is tapped off can be mixed into the primary combustion air or into the secondary combustion air. When household garbage is being incinerated, it is advantageous if the quantity of gas that is tapped off is ultimately used as secondary combustion air, because, as a rule, the proportion of combustion air that is added to the rear area of the grate and then tapped off, corresponds relatively precisely to the quantity that is required as secondary combustion air.

There are several advantageous configurations of the furnace grate for carrying out the procedure.

BRIEF DESCRIPTION OF THE DRAWINGS

The present invention will be described in greater detail below on the basis of an embodiment shown in the drawings appended hereto. These drawings show the following.

DESCRIPTION OF THE PREFERRED EMBODIMENTS AND BEST MODE

Figure 1:
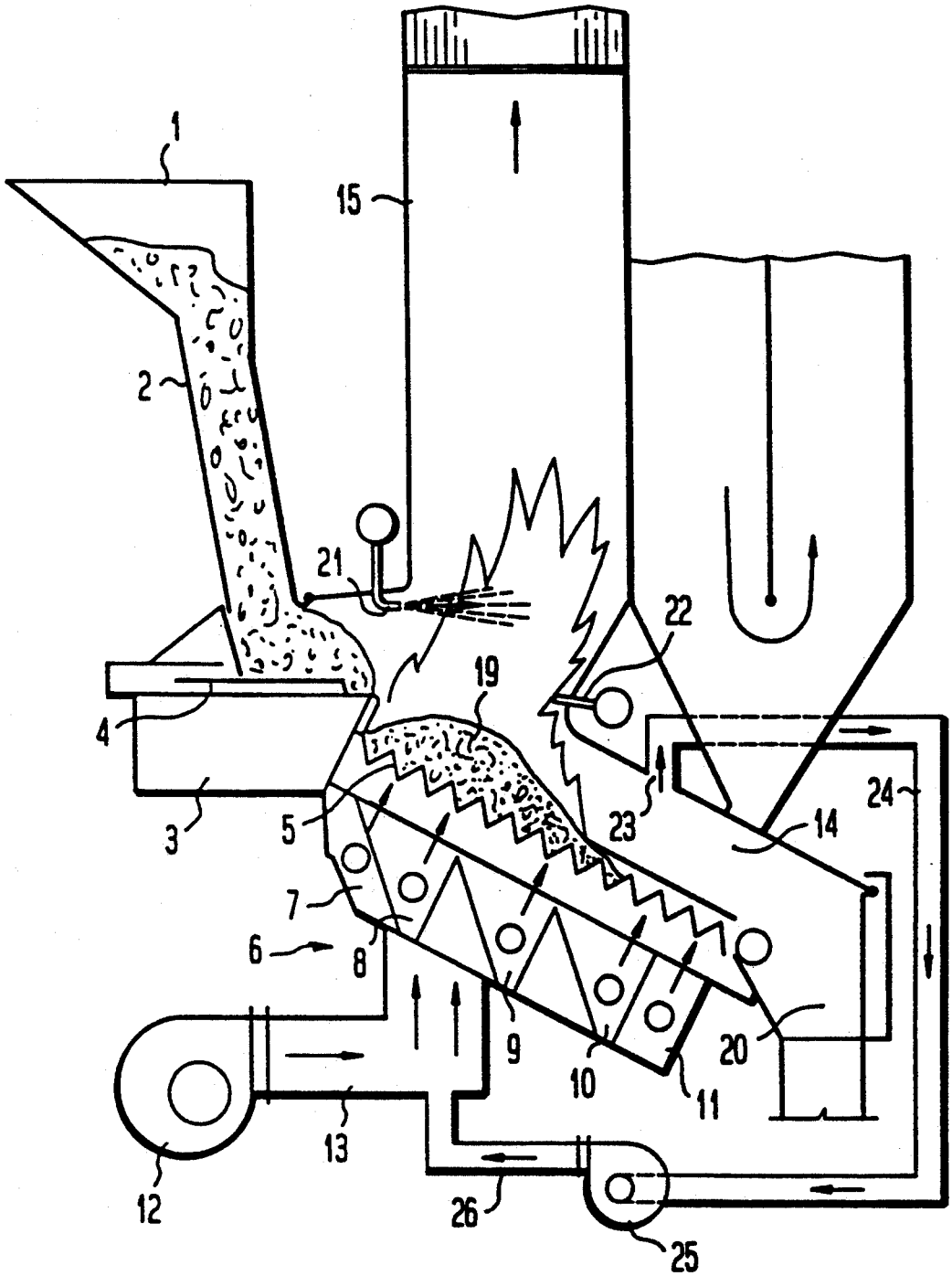
FIG. 1: a diagrammatic cross section through a first embodiment of a furnace.
Figure 2:
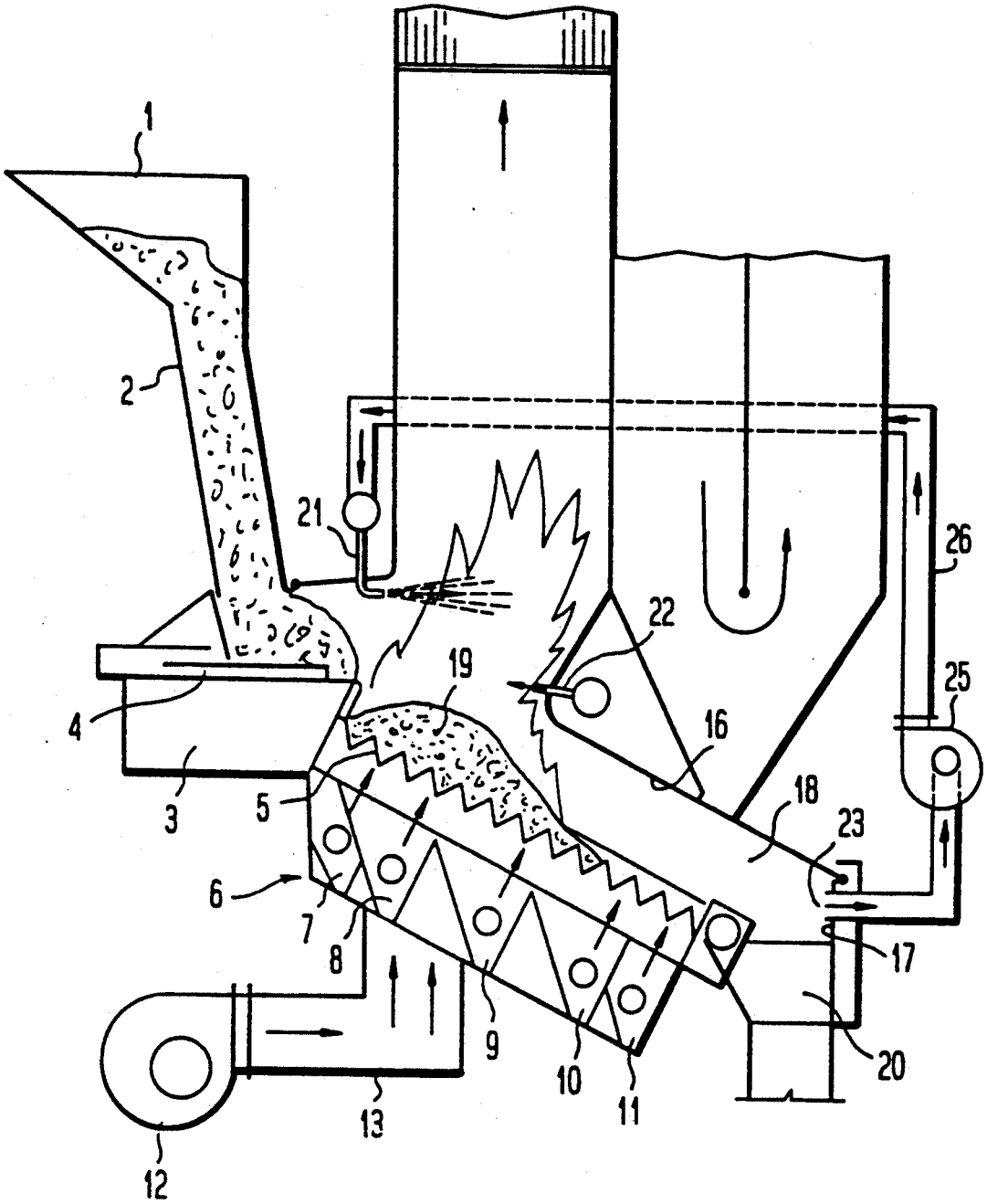
FIG. 2: a second embodiment that corresponds to FIG. 1.

As can be seen from FIGS. 1 and 2, a furnace incorporates an input hopper 1 with an adjacent input chute for feeding fuel onto a feeding disk 3 on which charging rams can move back and forth in order to move the fuel coming from the feed chute 2 onto a furnace grate 5, on which the combustion of the fuel takes place, in which connection it unimportant whether this is an inclined or a horizontal grate, regardless of the principle thereof.

Beneath the furnace grate 5 there is an apparatus, which bears the overall reference number 6, that is used to introduce primary combustion air; this can incorporate a plurality of chambers 7 to 11, to which primary combustion air is supplied through a line 13, by means of a fan 12. Because of the arrangement of the chambers 7 to 11, the furnace grate is divided into a plurality of undergrate blast zones, so that the primary combustion air can be adjusted variously, depending on the requirements of the furnace grate. Above the furnace grate 5 there is a combustion chamber 14 which, in the front section, becomes an exhaust gas flue to which, for example, a waste-heat boiler and a gas scrubber can be adjacent. In its rear area, the combustion chamber 14 is defined by a roof 16, a rear wall 17, and side walls 18 that can be seen, in particular, in FIG. 3.

Combustion of the fuel 19 takes place in the front part of the furnace grate 5, above which the waste gas flue 15 is located. In this area, most of the combustion air is delivered through the chambers 7, 8, and 9. On the rear part of the furnace grate 5 there is only fuel that has been completely burned, i.e., slag, and in this area primary combustion air is supplied through the chambers 10 and 11, in particular, only for cooling this slag and, in particular, for cooling the grate in order to keep it in operating condition. The burned parts of the fuel then fall into a slag outlet 20 at the end of the furnace grate 5. In the lower area of the exhaust gas flue 15, there are nozzles 21 and 22 which supply secondary combustion air to the rising exhaust gas, in order to bring about intensive secondary combustion of the combustible parts of the exhaust gas.

In the embodiment shown, exhaust gas is tapped off essentially in the rear part of the combustion chamber that is defined by the roof 16, the rear wall 17, and the side walls 18. To this end, in the embodiment shown in FIG. 1, there is an exhaust gas opening 23 in the roof 16, so that exhaust gas can be tapped off through the exhaust line 24 by means of a fan 25, the exhaust line 24 being connected to the suction side of the fan. A line 26 is connected to the pressure side of the fan and this forces the exhaust gas that has been tapped off into the line 13, through which the primary combustion air is supplied to the chambers 7 to 11.

In the embodiment shown in FIG. 2, the exhaust gas opening 23 is in the rear wall 17. In this embodiment, the line 26 that is connected to the pressure side of the fan 25 is connected, for example, to the nozzle 21 that serves to supply some of the secondary combustion air.

Figure 3:
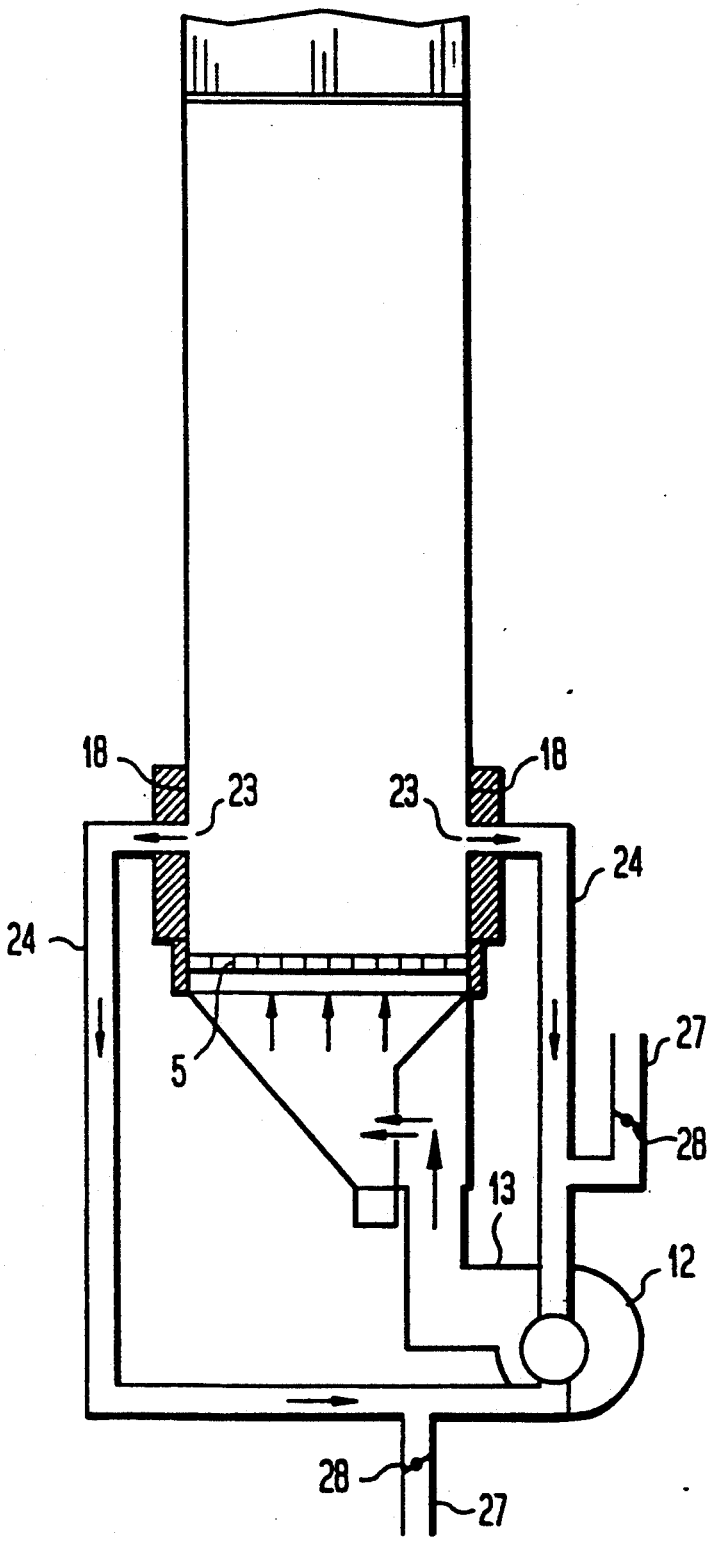
FIG. 3: a cross section through a furnace according to a further embodiment.

The embodiment shown in FIG. 3 shows the arrangement of two exhaust openings 23 in the side walls 18 of the combustion chamber 14, the exhaust lines 24 of which are connected to the suction side of fan 12. The exhaust lines are terminated by end pieces 27 that incorporate shut-off valves 28, through which additional fresh air can be drawn in and mixed with the exhaust gas.

What is claimed is:

1. A procedure for supplying combustion air in furnace grates, in which primary combustion air is introduced directly through the fuel and secondary combustion air is supplied directly into the flow of exhaust gas, and in which, in addition, some of the exhaust gas is tapped off from the exhaust gas flow and returned to the combustion process, wherein the exhaust gas is tapped off directly above the fuel in the area where there is a large part of unused primary air and returned to the combustion air, the quantity of which is reduced in accordance with the quantity of exhaust gas that is mixed with it.

2. A procedure as defined in claim 1, wherein the quantity of exhaust gas that is tapped off corresponds by volume to the volume of primary combustion air that is supplied to the furnace grate in the rear primary air zones.

3. A procedure as defined in claim 1, wherein the quantity of gas that is tapped off is smaller by volume than the quantity of primary combustion air that is supplied to the furnace grate in the rear primary zones.

4. A procedure as defined in claim 1, wherein the quantity of gas that is tapped off is larger by volume than the quantity of primary combustion air that is supplied to the furnace grate in the rear primary zones.

5. A procedure as defined in claim 1, wherein the quantity of exhaust gas that is tapped off is mixed with the primary combustion air.

6. A procedure as defined in claim 1, wherein the quantity of exhaust gas that is tapped off is mixed with the secondary combustion air.

7. A procedure as defined in claim 1, during the combustion of domestic garbage, wherein the quantity of exhaust gas that is tapped off is used exclusively as secondary combustion air.

8. A furnace for carrying out a procedure for supplying air to a combustion chamber, in which primary combustion air is introduced directly through a fuel to be consumed, secondary combustion air is supplied directly into a flow of exhaust gas, and a portion of the exhaust gas is channeled from the flow of exhaust gas and returned to the combustion chamber, the furnace comprising:

a grate for holding the fuel, said grate permitting said primary combustion air to pass therethrough;

a system for supplying primary combustion air through said grate and the fuel held thereon;

nozzles that open out into said combustion chamber for providing secondary combustion air, said nozzles being positioned at a first position;

an exhaust flue positioned above said nozzles for permitting said exhaust gas to escape from said combustion chamber; and, at least one exhaust line for channeling and returning a portion of said exhaust gas to said combustion chamber, said at least one exhaust line positioned below said first position with respect to said flow of exhaust gas.

9. The furnace of claim 8 wherein said at least one exhaust line is connected to said system for supplying primary combustion air to cause said portion to be returned to said combustion chamber as primary combustion air.

10. The furnace of claim 8 wherein said at least one exhaust line is connected to said nozzles to cause said portion to be returned to said combustion chamber as secondary combustion air.

11. The furnace of claim 8 wherein said at least one exhaust line is provided in at least one side wall of said combustion chamber above said grate.

12. The furnace of claim 8 wherein said at least one exhaust line is provided in a rear wall of said combustion chamber above said grate.

13. The furnace of claim 8 wherein the exhaust line is provided in a roof of said combustion chamber above said grate.

* * * * *